United States Patent [19]

Lachnit

[11] 3,958,541

[45] May 25, 1976

[54] DEVICE FOR LUBRICATING THE CAMS OF CAMSHAFTS

[75] Inventor: Detlev Lachnit, Opladen, Germany

[73] Assignee: Maschinenfabrik Augsburg-Nurnberg AG, Nurnberg, Germany

[22] Filed: Oct. 29, 1974

[21] Appl. No.: 518,758

[30] Foreign Application Priority Data

Oct. 26, 1973 Germany ..... 2353736

[52] U.S. Cl. ..... 123/90.34; 123/190 R; 184/65; 308/93; 308/108

[51] Int. Cl.² ..... F01M 1/06

[58] Field of Search ..... 123/196 R, 90, 34; 184/6.5, 11 R, 11 A; 308/100, 94, 93, 84, 78, 107, 108

[56] References Cited

UNITED STATES PATENTS

| | | | |
|---|---|---|---|
| 636,776 | 11/1899 | Eggleston | 308/94 |
| 1,070,109 | 8/1913 | Brochu | 123/196 R X |
| 2,625,448 | 1/1953 | Underwood | 308/78 |
| 2,674,904 | 4/1954 | Dickson | 123/90.34 X |
| 2,827,342 | 3/1958 | Roach | 184/6.5 X |
| 3,359,952 | 12/1967 | Jones et al. | 123/196 R X |
| 3,495,685 | 2/1970 | Van Rinsum | 184/6.5 |

*Primary Examiner*—Charles J. Myhre
*Assistant Examiner*—William C. Anderson
*Attorney, Agent, or Firm*—Walter Becker

[57] ABSTRACT

A device for lubricating the cams of camshafts of reciprocable piston engines according to which oil under pressure is supplied to circumferential and axial grooves provided in the bearing or bearings for the camshaft. From the axial groove or grooves oil is intermittently sprayed upon a selected surface of the cam or cams of the camshaft. To this end, the axial groove is radially spaced from the central axis of the camshaft, and intermittently at a certain circumferential angle relative to a selected surface portion of the cam, for instance the active elevated cam portion, oil under pressure is sprayed from the axial bore onto the selected cam surface to be lubricated.

8 Claims, 3 Drawing Figures

DEVICE FOR LUBRICATING THE CAMS OF CAMSHAFTS

The present invention relates to a device for lubricating the cams of camshafts of reciprocable piston engines, especially internal combustion engines, according to which oil under pressure is supplied to the camshaft bearings through inlet holes provided in the housing. The pressure oil exits from the end faces of the bearings and eventually flows out into the oil pan of the engine.

A device of this type is known, according to which, however, the oil, which slowly trickles down the end faces of the camshaft bearings, is collected in the closed camshaft housing until it reaches such a height that the cams are partially submerged in the oil. Only when the above mentioned oil level has been obtained does the oil flow back through overflow holes into the crankcase.

The drawback of the latter device consists in that the housing is relatively expensive and the assembly, or, for repairs, the disassembly of the camshaft is relatively complicated. In addition thereto, the bearings must respectively have such a great diameter that when the camshaft is mounted, the largest cam can be passed through the bearing.

It is also generally known to extend an oil feeding or supply conduit to the individual cams so that the running surfaces of the latter are continuously supplied with oil. The drawback of this device consists in that the conduits are awkward and costly. In addition thereto, it is not always easy to find the space to mount such additional conduits.

It is an object of the present invention, for a reciprocable piston engine, to achieve a certain and aimed cam lubrication in a simple manner without hindrance and without having to use supplementary means.

This object and other objects and advantages of the invention will appear more clearly from the following specification in connection with the accompanying drawing, in which.

Figure 1:
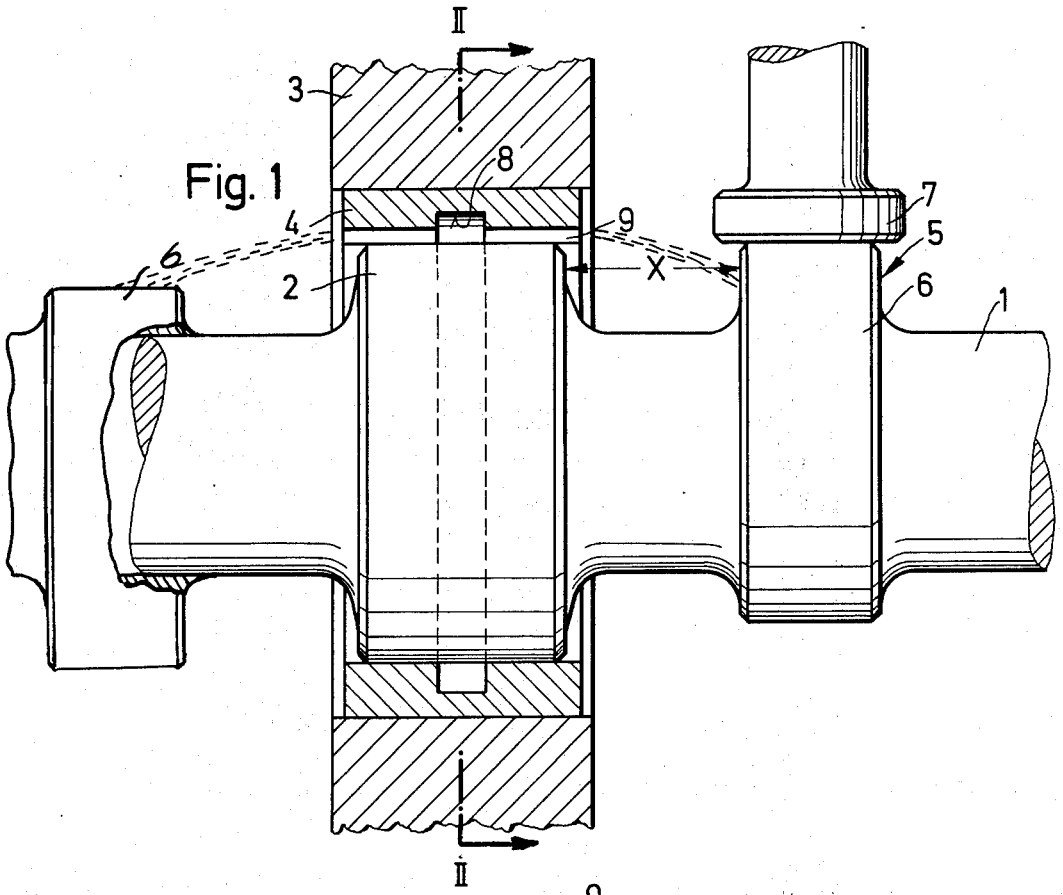
FIG. 1 is a side view of a section of the camshaft bearing according to the present invention.
Figure 3:
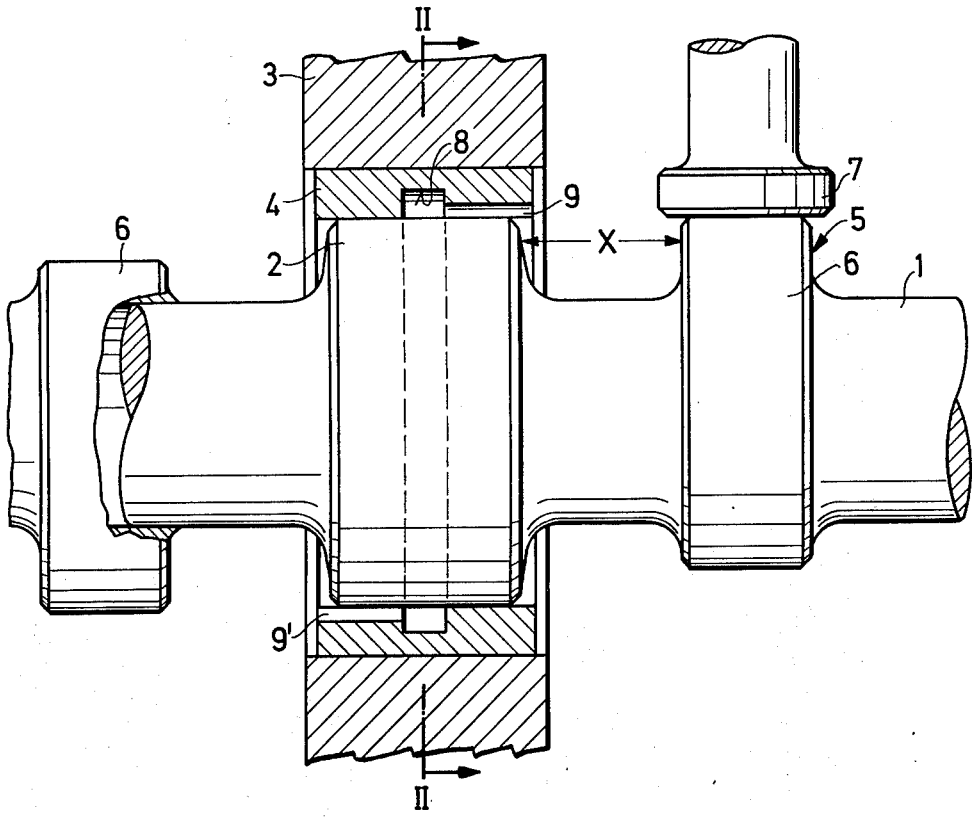

FIG. 3 represents a horizontal section through an arrangement similar to that of FIG. 1 but modified thereover in that the axial oil passage branching off from the radial groove toward one side of the bearing bushing is in the circumferential direction of the bearing bushing offset with regard to the axial oil passage branching off from said radial groove to the opposite side of said bearing bushing.

The device according to the present invention is characterized primarily in that at least one circumferential groove and one axial groove communicating therewith is provided in every camshaft bearing. The invention is further characterized in that the oil supply conduit discharges into the circumferential groove, and the axial groove is radially so spaced from the central axis of the camshaft and is arranged at a circumferential angle to the cam adjacent to the respective camshaft bearing in such a way that oil supplied under pressure is intermittently sprayed upon a certain specific portion of a cam surface at a specific time or at a specific angular position of the active cam surface relative to said axial groove.

The device according to the present invention completely realizes the stated object. No additional parts are required. Merely circumferential and axial are cut or milled into the bearing bushings. An additional advantage consists in that the lubrication of the cam surfaces is achieved precisely where desired, since those spots which are used mostly or are subjected to stresses will be quite intensively lubricated. An intermittent lubrication of the cam surfaces is achieved while the oil is continuously sprayed out of the axial groove or grooves. According to a further developement of the invention, the radial distance of the axial groove and the angle with regard to the adjacent cams are so selected that the oil strikes the leading most used flank of the cam before said flank reaches the pushrod.

In order to achieve a certain and intensive lubrication, the cross-sectional surface of the axial groove, the pressure of the oil, and the distance of the cam from the camshaft bearing are so selected that the oil does not or at least not materially get sprayed out beyond the respective cam surfaces. When the axial groove extends over the entire width of the camshaft bearing and when it is open on both sides, it is possible simultaneously to lubricate two cam adjacent to a respective camshaft bearing. An axial groove on one side of the circumferential groove may, depending on the position of the cams and the desired surfaces to be lubricated circumferentially be offset relative to another axial groove on the opposite side of the circumferential groove.

According to yet another development of the invention, two axial grooves may be arranged on the circumference of the camshaft bearing in such a way that respectively the leading and trailing cam flanks are sprayed with oil before they reach the pushrod. According to a further specific embodiment of the invention, the cross section of the axial groove has the shape of a circle segment. .

Since the oil which is used to lubricate the camshaft bearing is already under pressure, no auxiliary pump or the like is needed for spraying the cams with oil.

Referring now to the drawing in detail, the device shown in FIG. 1 comprises a portion of the camshaft 1, which, with a collar 2, is rotatably mounted in a bearing bushing 4 which is pressed or forced into the bearing wall 3. A cam 5 is located on the camshaft at a specific distance X from the bearing assembly 2, 4. The running surface 6 of the cam 5 cooperates with the partially shown pushrod 7. A circumferential groove 8 is worked into the bearing bushing 4 and communicates with a continuous axial groove 9.

Figure 2:
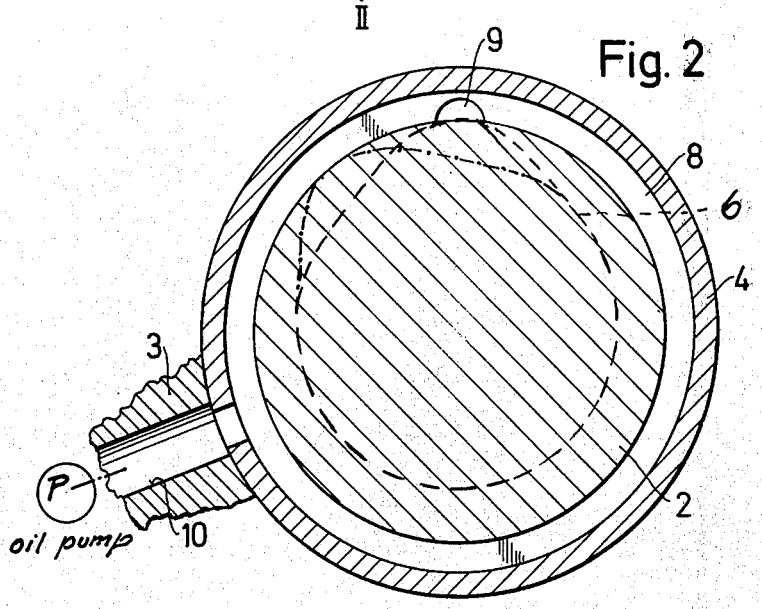
FIG. 2 is a section taken along the line II—II of the camshaft bearing illustrated in FIG. 1.

As shown in FIG. 2, an oil supply conduit 10, which is provided in the bearing wall 3 and passes through the bearing bushing 4, discharges into the circumferential groove 8. The axial groove 9 has a circular cross section.

As soon as the motor has been turned on and the oil pump which lubricates the motor has been started, oil under pressure is supplied to the circumferential groove 8 through the oil supply conduit 10. This pressure oil on one hand lubricates the entire bearing assembly 2,4 and at the same time sprays oil out from both sides of the axial groove 9. The radial distance of the axial groove 9, the oil pressure, the distance X, and the offset angle of the axial groove 9 relative to the cam 5 or pushrod 7 are so selected that with every rotation of the camshaft 1, at a specific time, oil is sprayed upon a particular part of the running surface 6 of the cam 5. While the surface area of the cam upon which the oil is to be sprayed is determined by the designer, in most instances the oil is sprayed upon the most used leading flank and/or upon the trailing flank of the cam 5. The offset angle may be selected in conformity with various aspects, e.g. in such a way that a lubricating oil wedge forms shortly before the push rod 7 engages the tip of the cam elevation. However, if desired, an aimed oil jet may hit the cam at the instant when due to a reversal of the pushrod movement, the pressure exerted by the push rod upon the cam is nearly zero. The selection of the offset angle is, of course, also influenced by the distance of the axial groove from the central axis of the camshaft and by the distance X of the cam from the camshaft bearing.

Using the arrangement of the axial groove as shown in FIG. 1, two cams may be lubricated simultaneously. If the two cams just mentioned are different or are circumferentiall offset with respect to each other, the two sections of the axial groove 9 in FIG. 1 may be offset to form grooves 9 and 9'. Naturally also two grooves of the type shown in FIG. 1 may be circumferentiall offset to each other.

It is, of course, to be understood that the present invention is, by no means, limited to the specific showing in the drawings but also comprises any modifications within the scope of the appended claims.

What I claim is:

1. In combination with a camshaft of a reciprocable piston engine, which camshaft is provided with cam means and which engine has an oil pump associated therewith; a device for lubricating the cam means of said camshaft, which includes bearing means, a camshaft rotatably journalled in said bearing means, each said bearing means being provided with at least one axial groove and at least one circumferential groove therein communicating with said axial groove, and an oil supply conduit communicating with said oil pump, and with said circumferential groove for supplying oil under pressure from the engine oil pump to said circumferential and axial grooves, said axial groove being so arranged relative to the cam surface to be lubricated that at selected times pressurized oil supplied to said axial groove is sprayed continuously from said axial groove to a particular selected portion of said cam means.

2. A device in combination according to claim 1, in which the oil which is supplied to said grooves also lubricates said bearing means.

3. A device in combination according to claim 1, in which said axial groove extends over the entire width of said bearing means and is open at both ends.

4. A device in combination according to claim 1, in which said axial groove extends to both sides of said bearing means from said circumferential groove and comprises two sections circumferentially offset relative to each other.

5. In combination with a camshaft of a reciprocable piston engine, which camshaft is provided with cam means and which engine has an oil pump associated therewith; a device for lubricating the cam means of said camshaft, which includes bearing means, a camshaft rotatably journalled in said bearing means, said bearing means being provided with at least one axial groove and at least one circumferential groove communicating with said axial groove, and and oil supply conduit communicating with said oil pump, and with said circumferential groove for supplying oil under pressure from the engine oil pump to said circumferential and axial grooves, said axial groove being so arranged relative to the cam surface to be lubricated that at selected times oil supplied to said axial groove is sprayed from said axial groove to a selected portion of said cam means, the axial distance between said axial groove and the adjacent cam means and the radial offset between the latter and said axial groove being such that the oil sprayed by said axial groove onto the effective cam area takes place prior to said cam means occupying maximum stroke position.

6. In combination with a camshaft of a reciprocable piston engine, which camshaft is provided with cam means and which engine has an oil pump associated therewith; a device for lubricating the cam means of said camshaft, which includes bearing means, a camshaft rotatably journalled in said bearing means, said bearing means being provided with at least one axial groove and at least one circumferential groove communicating with said axial groove, and an oil supply conduit communicating with said oil pump, and with said circumferential groove for supplying oil under pressure from the engine oil pump to said circumferential and axial grooves, said axial groove being so arranged relative to the cam surface to be lubricated that at selected times oil supplied to said axial groove is sprayed from said axial groove to a selected portion of said cam means, the cross-sectional surface of the axial groove and the pressure of the oil as well as the axial distance between said cam means and the bearing means for said camshaft being such that no material quantity of oil is sprayed beyond the respective active cam surface of said cam means.

7. In combination with a camshaft of a reciprocable piston engine, which camshaft is provided with cam means and which engine has an oil pump associated therewith; a device for lubricating the cam means of said camshaft, which includes bearing means, a camshaft rotatably journalled in said bearing means, said bearing means being provided with at least one axial groove and at least one circumferential groove communicating with said axial groove, and an oil supply conduit communicating with said oil pump, and with said circumferential groove for supplying oil under pressure from the engine oil pump to said circumferential and axial grooves, said axial groove being so arranged relative to the cam surface to be lubricated that at selected times oil supplied to said axial groove is sprayed from said axial groove to a selected portion of said cam means, and two axial grooves so arranged that the leading and trailing edge of the respective cam means are respectively hit by oil from said grooves prior to engaging a pushrod to be actuated thereby.

8. In combination with a camshaft of a reciprocable piston engine, which camshaft is provided with cam means, and which engine has an oil pump associated therewith; a device for lubricating the cam means of said camshaft, which includes bearing means, a camshaft rotatably journalled in said bearing means, said bearing means being provided with at least one axial groove and at least one circumferential groove communicating with said axial groove, and an oil supply conduit communicating with said oil pump, and with said circumferential groove for supplying oil under pressure from the engine oil pump to said circumferential and axial grooves, said axial groove being arranged relative to the cam surface to be lubricated that at selected times oil supplied to said axial groove is sprayed from said axial groove to a selected portion of said cam means, said axial groove having the cross section of a circle segment.

* * * * *